United States Patent [19]

Koch

[11] Patent Number: 4,457,227

[45] Date of Patent: Jul. 3, 1984

[54] EXTRACTION DEVICE

[75] Inventor: Klaus Koch, Laatzen, Fed. Rep. of Germany

[73] Assignee: Hermann Berstorff Maschinenbau GmbH, Hanover, Fed. Rep. of Germany

[21] Appl. No.: 319,896

[22] Filed: Nov. 10, 1981

[30] Foreign Application Priority Data

Nov. 29, 1980 [DE] Fed. Rep. of Germany ..... 3045138

[51] Int. Cl.[3] ..... B30B 9/12

[52] U.S. Cl. ..... 100/117

[58] Field of Search ..... 100/117, 145, 146, 147, 100/148, 149, 150; 366/79, 88, 89

[56] References Cited

U.S. PATENT DOCUMENTS

| | | | |
|---|---|---|---|
| 1,333,249 | 3/1920 | Fiddyment | 100/117 |
| 1,902,738 | 3/1933 | Tuttle | 100/148 |
| 3,230,865 | 1/1966 | Hibbel et al. | 100/147 |
| 3,902,704 | 9/1975 | Ishibashi et al. | 366/79 |
| 3,924,842 | 12/1975 | Klein et al. | 366/79 |

FOREIGN PATENT DOCUMENTS

| | | | |
|---|---|---|---|
| 298344 | 10/1971 | U.S.S.R. | 100/117 |

*Primary Examiner*—Peter Feldman
*Assistant Examiner*—Michael Knick
*Attorney, Agent, or Firm*—Schwartz, Jeffery, Schwaab, Mack, Blumenthal & Koch

[57] ABSTRACT

An extraction device for separating liquid from a liquid-solid mixture such as sludge or beet slices comprising a screw rotatably driveable in a barrel. The screw has a helical flight formed thereon defining a screw thread. The depth of the thread, in the axial direction of the screw, decreases in a direction opposite to the direction of conveyance of the material.

A secondary helical flight formed on the screw defines a second thread for conveying extracted liquid in a direction to the direction of conveyance of the mixture. The two threads are adjacent one another. The second thread is closed at each of its ends, upstream, in the direction of conveyance of the mixture, of an outlet in the barrel for the solid components and downstream of an inlet for the mixture.

2 Claims, 3 Drawing Figures

EXTRACTION DEVICE

BACKGROUND OF THE INVENTION

The present invention relates to an extraction device for separating liquid components of a material from the solid components thereof.

The device comprises a screw which is rotatable in a barrel and has flights helically disposed thereon. Screw threads are formed between the worm flights for conveying and extracting the liquid and solid mixture.

Such an extraction device, in the form of a screw press, is disclosed in U.S. Pat. No. 3,230,865. However, the screw of the device disclosed in such specification has threads between the worm flights which are of constant width and depth along the entire length of the screw. By rotating the screw, the material to be extracted is conveyed by the active side of the flight, that is to say, the face of the flight facing downstream in the direction of conveyance of the material, through the screw barrel. The material is therefore subjected to a much greater pressure by the active flank than the passive flank of the flight. The passive flank of the flight is, of course, the flank lying opposite the active flank.

The effect such action has upon the material is discernable as a sliding, rolling movement of the material and the setting up of a high pressure within the barrel.

However, the liquid separated from the solid by the high pressure re-mixes with the solid because the entire content of material in the screw thread is pushed forwardly, in a rotary manner, in front of the active flight flank.

The remixing of the liquid with the solid obviously results in the separation effect being considerably impaired and, accordingly, causes the separation to be effected in a very uneconomical manner.

The present invention seeks to provide an extraction device which permits an economical separation of a liquid and solid mixture to be effected. In particular, the invention seeks to provide a device in which it is ensured that the mixture, once it has been acted upon by pressure and part of the liquid extracted therefrom, cannot be re-mixed with the extracted liquid.

According to the present invention, there is provided an extraction device for separating liquid components of a mixture from solid components thereof comprising a screw press having a barrel defining an inlet opening for the mixture and an outlet for the extracted solid material, a drivable rotatable screw located within the barrel, the screw having two screw flights helically disposed thereon, screw threads being defined between the flights, one of said threads forming a press screw thread along which the material to be extracted is conveyed and subjected to extraction by rotation of the screw, the other thread forming a discharge thread for liquid extracted from the material, the discharge thread carrying the liquid in a direction substantially opposite the conveying direction, the depth of the press thread, viewed in the axial direction of the screw increasing in the direction of conveyance of the material to be extracted, the discharge thread being located adjacent the press thread and being closed at each end at points respectively downstream of the inlet opening and upstream of the outlet opening for the solid material.

Preferably, the discharge screw thread has a cross-sectional area corresponding substantially to one-third of the cross-sectional area of the press thread.

The device of the present invention permits the liquid and solid mixture to be subjected to an intensive pressing action in a direction towards the active flight flanks. This is because the active flight flanks have a thread depth which increases in the direction of conveyance of the material, thereby defining a substantially V-shaped slot.

Because of the conveying movement of the screw, the extracted liquid is forced through the gap between the ridge of the flights and the internal wall of the barrel. Due to the large drop in pressure in this region, the liquid passes into the rearwardly directed discharge screw thread and is transferred back to the feed section of the extraction device where filter openings are provided for discharging the liquid.

The liquid may therefore flow out of the filter openings and will have no solid matter mixed therewith, because the discharge screw thread terminates, in a closed end, at a point downstream, in the direction of conveyance of the material, of the inlet opening. Accordingly, the solid-containing material entering through the inlet cannot drop straight into the discharge thread.

The drop in pressure along the discharge screw thread to the filter openings located in the feed region is sufficient for the extracted liquid to be rapidly discharged.

The provision of a discharge screw thread for conveying the extracted liquid in a direction counter to the direction of conveyance of the material adjacent to the press thread effecting the extraction ensures that the liquid is physically separated from the solid material and is discharged from the site at which it has been extracted.

The extracted liquid, located in a separate thread from the unextracted mixture, cannot therefore come into contact with the mixture. Because of this, the extraction process is economic. More particularly, once the mixture had some of the liquid extracted therefrom, it may be subjected to more intensive pressing. However, it must also be emphasized that the device of the present invention also reduces capital expenditure because only a relatively short screw length compared with known devices is required to achieve a high dry-substance content.

Because of the rotational movement of the screw in the barrel, the mixture to be extracted is subjected to a rolling action between the internal wall of the barrel, the base of the thread and the active flight flanks. Because of the bevelling or narrowing of the press thread in an upstream direction, that is to say, in a direction counter to the conveying direction, the mixture is effectively pressed into a narrow V-slot, whereby the pressure acting on the mixture is intensified.

This pressure is increased by the rolling movement of the material towards the active flanks of the flight. In addition, there is a constant re-arrangement of the material in the press thread because of the rolling movement, and such re-arrangement assists in the breaking down of the solid material, and also, therefore, in the extraction.

In an extraction device in accordance with the present invention, the following effects occur. Firstly, because of the rotational movement of the screw, which conveys the material towards the outlet end of the screw, the mixture to be extracted is forced into a narrowing V-slot in which it is forced to execute a rolling movement. The nearer the mixture progresses towards the narrowest point of the V-slot, a build-up of pressure acts thereon and hence the quantity of liquid which is extracted is increased.

Due to the rotational movement of the screw, the extracted liquid is forced to pass rearwardly over the flight into the discharge screw thread. Since only liquid and a very small amount of very small particles of comminuted solid matter can pass through the narrow gap between the ridge of the flight and the internal wall of the barrel, there is a considerable drop in pressure of, for example, from 30 to 3 bars between the press screw thread and the rearwardly directed discharge screw thread located upstream thereof in the direction of conveyance of the mixture. Since the discharge screw thread extends back to the filter openings in the screw cylinder, it is possible for the extracted fluid to be discharged from the screw press without the pressure in the press thread dropping substantially.

The extracted liquid is separated from the solid material at the site of extraction and is discharged from the device without being able to mix with any solid component of the mixture. Since the discharge screw thread does not extend sufficiently far rearwardly so as to be located beneath the inlet opening and because it is also closed at its rearward end, no solid material can enter into the discharge screw thread in the feed region of the device. The discharge of the liquid is therefore unaffected by any solid components of the mixture.

Since the discharge screw thread is also closed in the front or downstream region of the extraction device upstream of the outlet opening, no solid matter may gain access to the discharge thread in such region.

BRIEF DESCRIPTION OF THE DRAWINGS

One preferred embodiment of the device will be further described, by way of example, with reference to the accompanying drawings in which:

In FIG. 1, there is shown an extraction device including a feed hopper 1 into which a liquid and solid mixture to be extracted is inserted. The mixture is forced through the device by a press screw 2. The screw 2 is caused to rotate by means of a drive unit (not shown) and is surrounded by a barrel 3. Filter openings 4 are formed in the feed region of the barrel 3.

Figure 1:
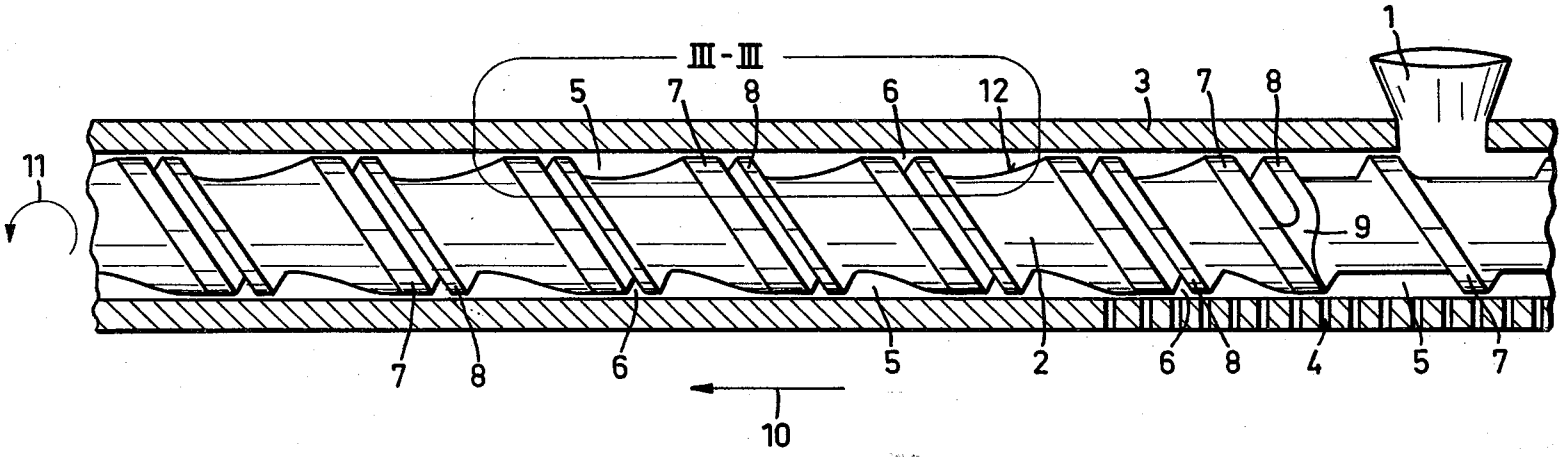
FIG. 1 is a schematic longitudinal view, partially in section through an extraction device in accordance with the present invention.

The screw 2 has helically extending flights 7 and 8 formed thereon. The flight 8 commences, however, on the flight 7 at a junction point 9 and has an initial portion which is directed away from the flight 7. The major portions of the flight 8 does, however, extend parallel to the flight 7. Accordingly, between the flights 7 and 8, two screw threads 5 and 6 are defined. The thread 5 is a press thread and the thread 6 is a discharge thread. As can be seen from the drawings, the discharge screw thread 6 has a cross-sectional area corresponding substantially to one-third of the cross-sectional area of the press thread 5.

Figure 3:
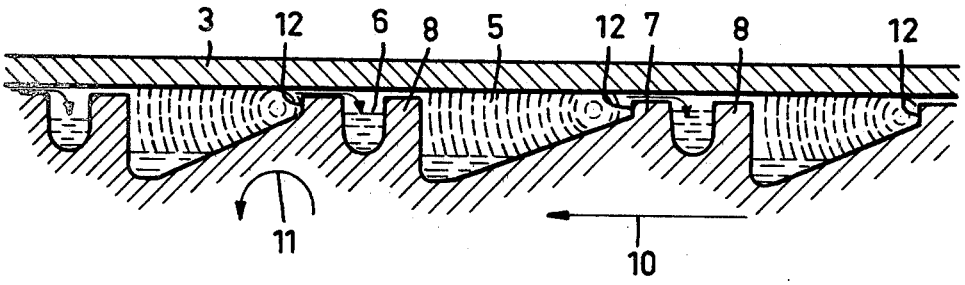
FIG. 3 is a longitudinal section through the screw and barrel of the portion of the device ringed at III—III in FIG. 1.
Figure 2:
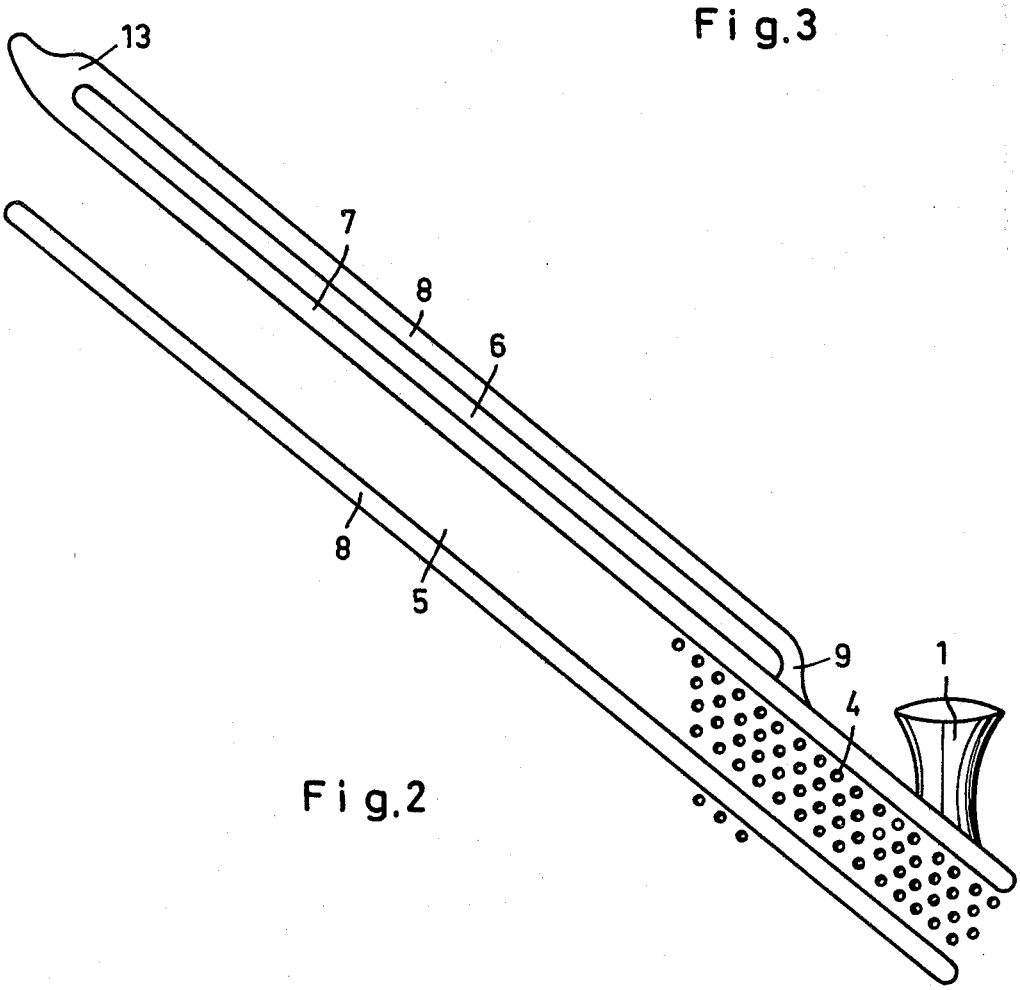
FIG. 2 shows a development of the worm which has a press screw thread and a discharge screw thread, this Figure also showing a feed hopper and filter opening forming part of the device shown in FIG. 1.

The thread 5 has a thread depth which increases in the direction of conveyance of the material. Accordingly, V-shaped slots and channels are defined. Such slots or channels can best be seen in FIG. 3.

The direction of conveyance of material in the device is indicated by the arrow 10, whilst the direction of rotation of the screw 2 is indicated by the arrow 11.

In the press thread 5, the liquid and solid mixture is subjected to an intensive pressing action, the active flank 12 of the flight 7 moving in the direction of the arrow 10 due to the rotation of the screw 2. The mixture therefore executes a rolling movement in front of the flank 12 and is simultaneously subjected to an increasing pressure as the gap narrows due to the rotation of the screw 2.

The extracted liquid passes over the flight 7 into the discharge thread 6 and is directed rearwardly towards the feed section. Because of the drop in pressure as this occurs, the liquid returns to the filter openings 4, from which it is discharged.

At the front or downstream end of the device, the flight 8 is reconnected to the flight 7. This prevents solid matter from passing into the discharge screw thread 6 at the downstream end of the extraction device.

I claim:

1. An extraction device for removing liquid from a solid-liquid mixture comprising a having a dimiensionally fixed interior surface, hollow barrel, filter openings formed in said barrel below said inlet means, said barrel, having first and second end sections, said first end section including inlet means for supplying said mixture to the interior of said barrel, said second end section including outlet means for said solid components of said mixture, said first flight means having a peripheral edge spaced closely adjacent the fixed interior surface of said barrel thereby defining with said barrel a press thread in which the solid-liquid mixture is subjected to an intensive pressing action resulting in liquid being released from the mixture rotatably driveable screw means disposed within said hollow barrel, first flight means helically disposed on said hollow barrel, said first flight means defining a continuous thread for carrying said mixture and for extracting said liquid therefrom, said first flight means and said barrel jointly defining a flow path for said mixture, said flow path having an upstream and a downstream end region surface, and second flight means helically disposed on said screw means and located adjacent said first flight means, said second flight means having a peripheral ridge spaced closely adjacent the interior surface of said barrel thereby defining therewith a relatively small, fixed gap through which only liquid and very small particles of comminuted solid matter can pass, said second flight means defining with said first flight means a discharge thread for carrying said liquid removed from said mixture in a direction opposite to that of said flow path for said mixture, said thread defined by said second flight means having first and second closed ends, said first end being closed upstream, in the direction of flow of said mixture, of said outlet means for said solid components of said mixture and said second end being closed downstream, in said direction of flow of said mixture, of said inlet means, said discharge thread communicating with said fitter openings.

2. An extraction device as recited in claim 1 wherein the cross-sectional area of said thread defined by said first flight means is substantially three times the cross-sectional area of said thread defined by said second flight means.

* * * * *